US007211004B2

(12) United States Patent
DeMarco

(10) Patent No.: US 7,211,004 B2
(45) Date of Patent: May 1, 2007

(54) GOLF GLOVE AND SYSTEM FOR GRIP ASSISTANCE

(76) Inventor: Joseph DeMarco, P.O. Box 833, Dayton, NJ (US) 08810

( * ) Notice: Subject to any disclaimer, the term of this patent is extended or adjusted under 35 U.S.C. 154(b) by 330 days.

(21) Appl. No.: 10/852,516

(22) Filed: May 24, 2004

(65) Prior Publication Data

US 2005/0268372 A1 Dec. 8, 2005

(51) Int. Cl.
*A63B 71/14* (2006.01)
*A41D 19/00* (2006.01)

(52) U.S. Cl. ..... 473/201; 473/205; 473/206; 473/212; 473/213; 473/409; 2/161.2; 2/161.3; 2/161.4

(58) Field of Classification Search ..... 473/201–206, 473/212–213, 458, 450, 464, 409; 2/160–161.4
See application file for complete search history.

(56) References Cited

U.S. PATENT DOCUMENTS 1,681,389 A * 8/1928 Blake ..... 473/205
2,270,882 A * 1/1942 Link ..... 2/159
2,293,347 A * 8/1942 Lindfelt ..... 2/161.2
2,302,875 A * 11/1942 Lykins ..... 2/161.3
2,877,465 A * 3/1959 Stroud ..... 2/20
3,368,811 A * 2/1968 Finney ..... 473/300
3,394,408 A * 7/1968 Bush ..... 2/159
3,508,280 A * 4/1970 Osborn ..... 2/159
3,532,344 A 10/1970 Masstab
4,665,565 A * 5/1987 Odom ..... 2/161.2
5,845,374 A * 12/1998 Briggs ..... 24/442
5,890,228 A * 4/1999 Wagner ..... 2/160
6,035,442 A * 3/2000 Marando ..... 2/161.1
6,146,319 A * 11/2000 Tarail ..... 482/139
6,427,246 B1 * 8/2002 Doi et al. ..... 2/161.1
6,912,731 B2 * 7/2005 Cass ..... 2/161.1
2004/0142756 A1 * 7/2004 Oury ..... 473/205

* cited by examiner

*Primary Examiner*—Sebastiano Passaniti
(74) *Attorney, Agent, or Firm*—Mathews, Shepherd, Mckay & Bruneau, P.A.

(57) ABSTRACT

A golf glove and system useful in assisting a person having insufficient control of hand using a golf club to effectively strike a golf ball. The golf glove enables the person having insufficient control of hand to grasp and swing the golf club to effectively strike the golf ball without the assistance of another person.

17 Claims, 3 Drawing Sheets

GOLF GLOVE AND SYSTEM FOR GRIP ASSISTANCE

BACKGROUND OF THE INVENTION

1. Field of the Invention

The present invention relates to a golf glove and system useful in assisting a person having insufficient control of one or more of their hands to use a golf club to effectively strike a golf ball. The golf glove enables the person having insufficient control of one or more of their hands to grasp and swing the golf club to effectively strike the golf ball without the assistance of another person.

2. Related Art

Playing golf requires that a golfer's hand create enough gripping force with the club to allow swinging action and impact with the golf ball. Those persons who have insufficient control of their hands or a handicap, such as an injury or a diseased-induced reduction in the strength of one or more of their hands, may simply be unable to play golf because of a lack of the requisite degree of gripping power needed to ensure the appropriate use of the club during the swing and impact of the ball.

The use of golf gloves is well-known. Generally, a golf glove is worn on the hand of the weaker arm. Accordingly, a right-handed golfer wears a glove on their left-hand and vice-versa. The golf glove is designed to protect the surfaces of the hand from irritation and blistering from repeatedly using a golf club during play. However, despite the use of a golf glove, the golfer must still grasp the handle portion of the golf club with their gloved hand in a firm manner, relying on the muscles in their hand and forearm to create a sufficiently strong grip so that the golf club can be effectively used.

U.S. Pat. No. 3,532,344 describes a golf glove and golf club grip having non-slip elements and grip positioning surfaces to improve gripping. The glove and handle are provided with a hooked fabric component on a portion of the palm and a separable fastener area located at the fourth and fifth finger tip areas. This reference is directed to helping persons develop the proper grip to play golf. However, this arrangement does not provide stability of the golf club to enable a person with little or no strength to use a glove that will provide enough gripping force in the gripping area of the glove to enable the person to grasp the handle of the golf club and swing and strike a golf ball without the assistance of another person.

It is therefore desirable to provide a golf glove with enough gripping force in the gripping area of the golf glove to enable a person with insufficient control of their hands to effectively grasp and strike a golf ball.

SUMMARY OF THE INVENTION

An appropriately configured golf glove with enough gripping force in the area of the finger portions and palm portions of the glove can provide even a handicapped person with little or no strength in their fingers, palm and forearms with the appropriate gripping force to enable them to play golf.

Also, a system that uses a golf glove to help a handicapped person with little or no strength in their fingers, palm and forearms develop strength and coordination to enable them to play golf and, subsequently once the person's strength and coordination improves the system provides the appropriately configured golf glove with enough gripping force in the area of the finger portions and palm portions to enable them to play golf without the assistance of another person.

The invention provides a system for assisting a person having insufficient control of one or more hands to use a golf club for effectively striking a golf ball. The system includes a golf glove having a gripping area. The gripping area includes a digit portion and a palm portion. The digit portion includes a first adhesion material and the palm portion also includes the first adhesion material. A second adhesion material is also adapted to be attached to a handle portion of the golf club wherein the first adhesion material of the gripping area of the golf glove is removably connected to the second adhesion material of the handle portion of the golf club to enable the person having insufficient control of hand to use the golf glove on the hand to effectively strike the golf ball.

Another embodiment of the invention provides a combination for assisting a person having insufficient control of one or more hands to use a golf club for effectively striking a golf ball. The combination includes a golf glove having a gripping area. The gripping area includes a digit portion and a palm portion. The digit portion includes a first adhesion material and the palm portion also includes the first adhesion material. A second adhesion material is also adapted to be attached to a handle portion of the golf club wherein the first adhesion material of the gripping area of the golf glove is removably connected to the second adhesion material of the handle portion of the golf club to enable the person having insufficient control of hand to use the golf glove on the hand to effectively strike the golf ball.

Another embodiment of the invention provides a system having instructional material for assisting a person having insufficient control of one or more hands to strengthen and improve coordination of the hand and use a golf club for effectively striking a golf ball. The system includes a first golf glove having a palm portion and a wrist portion. The palm portion includes a holding bracket attached to the palm portion and the wrist portion includes a holding strap. The holding bracket and holding strap secure the hand having insufficient control to a handle portion of the golf club to enable the person having insufficient control of one or more hands to improve strength and coordination of the hand for effectively striking the golf ball. The system also includes a second golf glove having a gripping area. The gripping area has a digit portion and a palm portion. The digit portion includes a first adhesion material and the palm portion also includes the first adhesion material. A second adhesion material is adapted to be attached to the handle portion of the golf club. The first adhesion material of the gripping area of the second golf glove is removably connected to the second adhesion material of the handle portion of the golf club to enable the person having insufficient control of hand to use the second golf glove on the hand for effectively striking the golf ball. Also, the instructional material instructs the person having insufficient control of one or more hands to use the first golf glove to strengthen and improve coordination of the hand having insufficient control during use of golf club, and subsequently to use the second golf glove on the hand to use the golf club for effectively striking the golf ball without the assistance of another person.

Another embodiment of the invention provides a kit for training a person having insufficient control of one or more hands for effectively striking a golf ball. The kit includes a first golf glove having a palm portion and a wrist portion. The palm portion includes a holding bracket attached to the palm portion and the wrist portion includes a holding strap.

The holding bracket and holding strap secure the hand having insufficient control to a handle portion of the golf club to enable the person having insufficient control of one or more hands to improve strength and coordination of the hand for effectively striking the golf ball. The kit also includes a second golf glove having a gripping area. The gripping area includes a digit portion and a palm portion. The digit portion has a first adhesion material. The palm portion also includes the first adhesion material. A second adhesion material is adapted to be attached to the handle portion of the golf club. The first adhesion material of the gripping area of the second golf glove is removably connected to the second adhesion material of the handle portion of the golf club to enable the person having insufficient control of hand to use the second golf glove on the hand for effectively striking the golf ball.

The kit also includes instructional material. The instructional material instructs the person having insufficient control of one or more hands to use the first golf glove to strengthen and improve coordination of the hand having insufficient control during use of golf club, and subsequently to use the second golf glove on the hand for effectively striking the golf ball without the assistance of another person.

BRIEF DESCRIPTION OF THE DRAWINGS

The advantage, nature, and various additional features of the invention will appear more fully upon consideration of the illustrative embodiments now to be described in detail in connection with accompanying drawing wherein.

DETAILED DESCRIPTION OF THE INVENTION

Figure 1B:
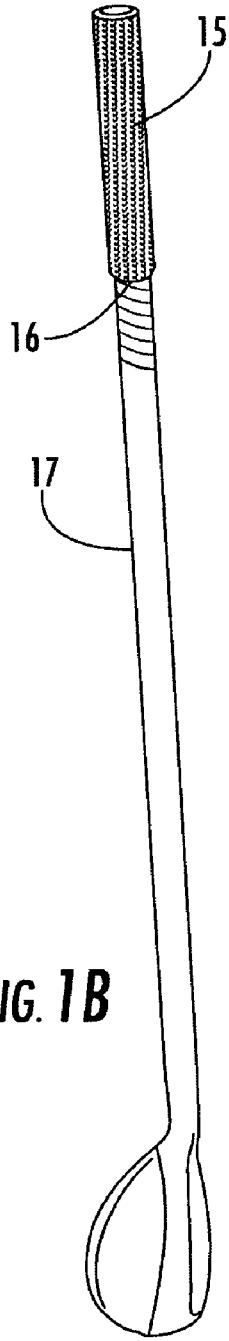
FIG. 1B is a schematic diagram of an adhesion material attached to a golf club handle.
Figure 1A:
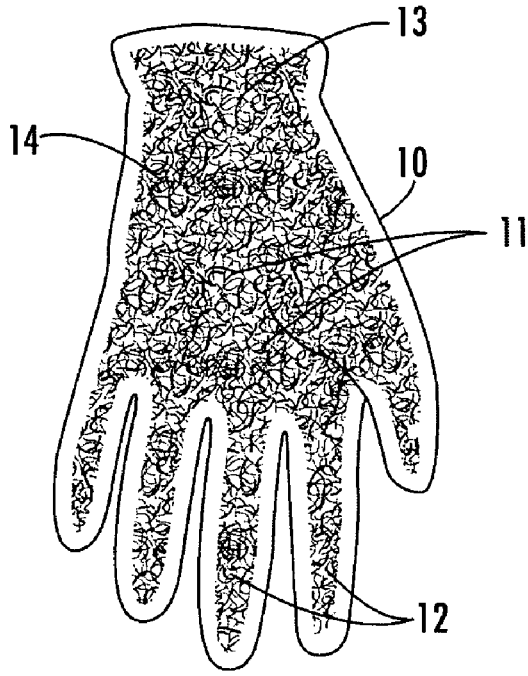
FIG. 1A is a schematic diagram of a golf glove for assisting a person with insufficient control of one or more of their hands.

Referring to the drawings wherein like reference numerals similar or like elements throughout the several views and initially to FIG. 1A there is shown an exemplary embodiment of the present invention. FIG. 1A shows golf glove 10 in accordance with the present invention. Golf glove 10 assists a person having insufficient control of one or more of their hands to grip a golf club and effectively strike a golf ball. Golf glove 10 thereby enables a person having insufficient control of one or more of their hands to grasp and swing a golf club to strike a golf ball without the assistance of another person.

Golf glove 10 includes gripping area 11. Gripping area 11 includes digit portion 12 and palm portion 13. Finger portion 12 and palm portion 13 include first adhesion material 14. At least three fingers of digit portion 12 include first adhesion material 14 to provide enough gripping force to enable a person with little or no hand strength to effectively grasp and swing the golf club. An exemplary embodiment of adhesion material 14 is a hook and loop fastener system such as Velcro. Other adhesion materials include but are not limited to glue and adhesive tapes. First adhesion material 14 can be glued, taped or stitched to finger portion 12 and palm portion 13.

In one embodiment, entire gripping area 11 can be formed of first adhesion material 14. In an alternative embodiment, golf glove 10 can be formed of adhesion material 14.

FIG. 1B shows second adhesion material 15 attached to handle portion 16 of golf club 17. Second adhesion material 15 is designed to be removably connected to first adhesion material 14. An exemplary embodiment of second adhesion material 15 is the reciprocal of the hook and loop Velcro fastener used for first adhesion material 14. Other adhesion materials include but are not limited to glue and adhesive tapes. Second adhesion material 15 can be glued, taped or stitched to handle portion 16 of golf club 17. In one embodiment, handle portion 16 can be formed from second adhesion material 15.

Figure 2:
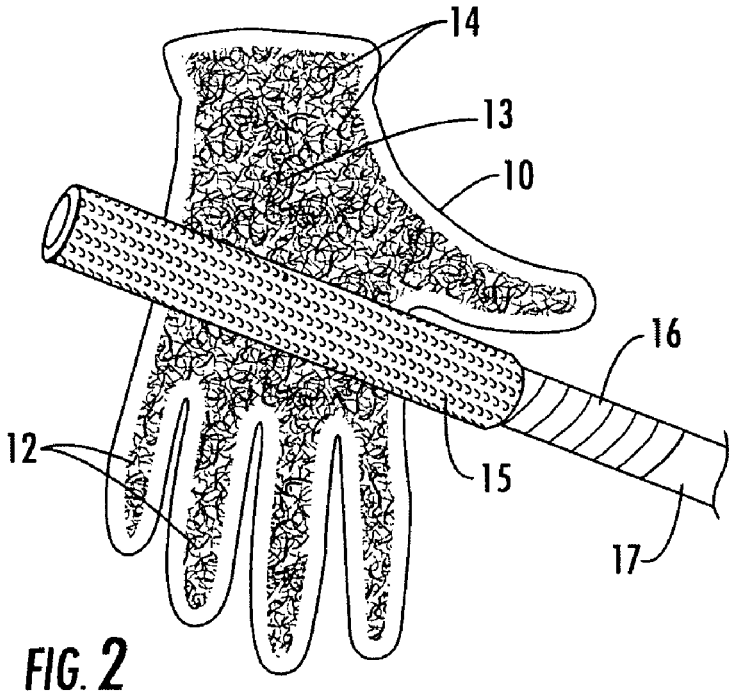
FIG. 2 is a schematic illustration of the golf glove depicted in FIG. 1A used in combination with the adhesion material depicted in FIG. 1B.

FIG. 2 schematically illustrates golf glove 10 being used with second adhesion material 15 attached to handle portion 16 of the golf club 17. First adhesion material 14 of digit portion 12 and palm portion 13 of gripping area 11 of golf glove 10 is positioned around and pressed to second adhesion material 15 attached to handle portion 16 of golf club 17 to removably connect first adhesion material 14 to second adhesion material 15. Pressing first adhesion material 14 to second adhesion material 15 produces an intermeshing or locking of the hooks with the loops, such as in Velcro, to provide a bond of surprising strength and shear to enable a person having insufficient control of one or more hands to effectively grasp the golf club and use the golf club to strike the golf ball.

Insufficient control of one or more hands includes but is not limited to types and degrees of disability that follow a stroke such as paralysis or problems controlling movement.

The term "Effectively hit or strike a golf ball" includes but is not limited to making contact between the golf ball and the golf-club head while advancing the golf ball forward to the intended target.

The term "Gripping force" refers to sufficient force to maintain the golf club in a fixed position within the player's hand with little or no force exerted by the player's hand.

The term "Coordination" refers to the proper swing motion of a golf club to effectively hit or strike a golf ball.

Figure 3:
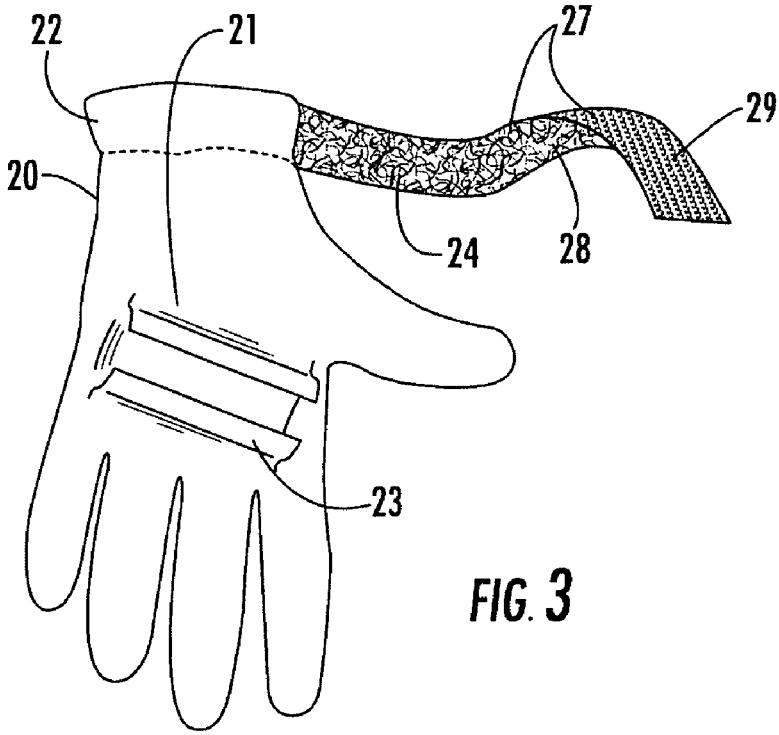
FIG. 3 is a schematic diagram of a golf glove for assisting a person with insufficient control of one or more of their hands to improve strength and coordination.

FIG. 3 shows golf glove 20 in accordance with another embodiment of the present invention. Golf glove 20 assists a person having insufficient control of one or more of their hands to strengthen and improve coordination of the hand and effectively hit or strike a golf ball with a golf club.

Golf glove 20 includes palm portion 21 and wrist portion 22. Palm portion 21 includes holding bracket 23. An exemplary embodiment of holding bracket 23 is a bracket with an opening sufficient to permit shaft 18 of golf club 17 to fit within the bracket. Once shaft 18 of golf club 17 is received within holding bracket 23, golf club 17 can slide down to enable handle portion 16 of golf club 17 to be positioned within holding bracket 23.

Holding bracket 23 is formed of a hardened elastomeric material that includes but is not limited to plastic, polyvinyl chloride, and the like.

Wrist portion 22 includes holding strap 24. Holding strap 24 includes front portion 25 and rear portion 26. Front portion 25 and rear portion 26 include adhesion material 27. An exemplary embodiment of adhesion material 27 is a hook and loop fastener system such as Velcro. Other adhesion materials include but are not limited to glue and adhesive tapes. Adhesion material 27 can be glued, taped or stitched to holding strap 24.

Figure 4:
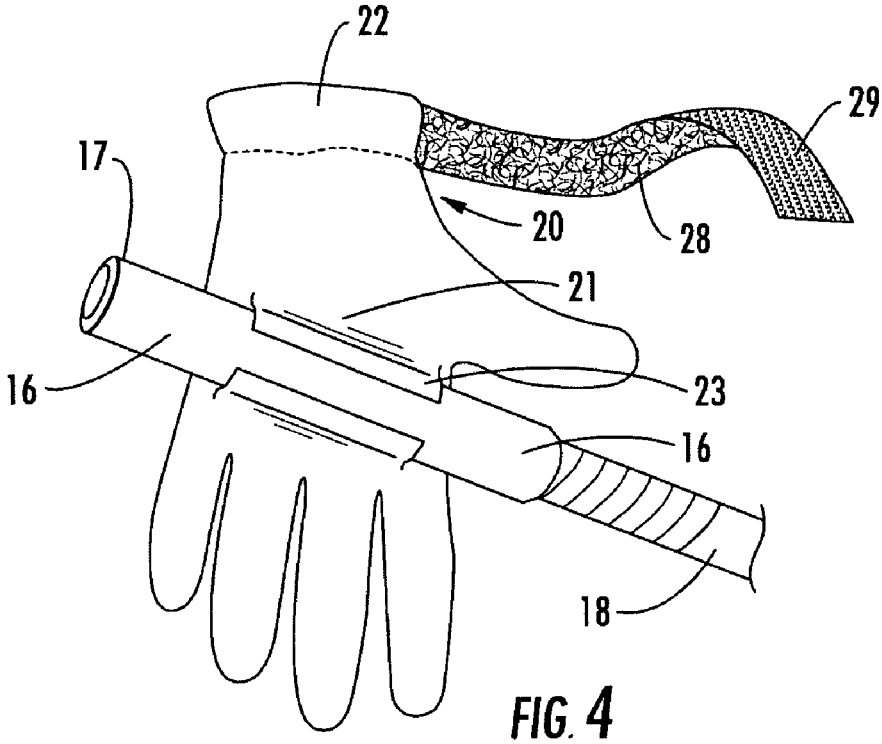
FIG. 4 is a schematic illustration of the golf glove depicted in FIG. 3 used with a golf club.
Figure 5:
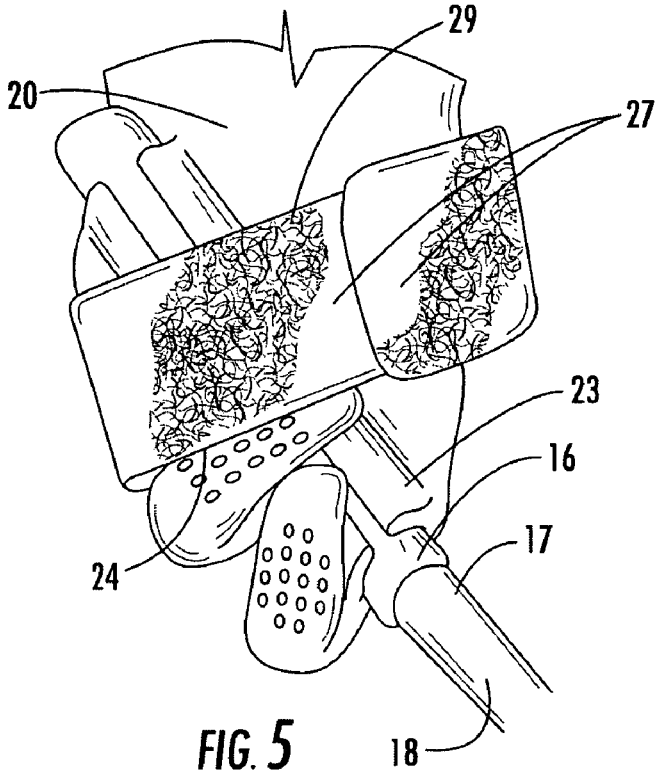
FIG. 5 is a schematic diagram of holding bracket and holding strap depicted in FIG. 3 securing the golf club in a person's hand.

FIG. 4 schematically illustrates golf glove 20 being used with golf club 17. Shaft 18 of golf club 17 is positioned within holding bracket 23 and slid down to position handle portion 16 of golf club 17 within holding bracket 23. Holding strap 24 is wrapped around golf club 17 within holding bracket 23 and around a hand of a person which has insufficient control. Holding strap 24 is tightened and front portion 28 holding strap 24 having adhesion material 27 is pressed to adhesion material 27 of rear portion 29 of holding strap 24 to produce an intermeshing or locking of the hooks with the loops, such as in Velcro, to secure golf club 17 within holding bracket 23 and to the person's hand having insufficient control. Other tightening means for holding strap 24 include but are not limited to locking brackets, or ring systems, such as those used with clothing belts, clothing straps, and clothing suspenders.

Golf glove 20 could be used to enable the person to effectively improve strength and coordination of their hand and to use golf club 17 to strike or hit a golf ball. Subsequently, after the person improves their strength and coordination of one or more hands by using golf glove 20, the person can use glove 10 depicted in FIG. 1A.

Figure 6:
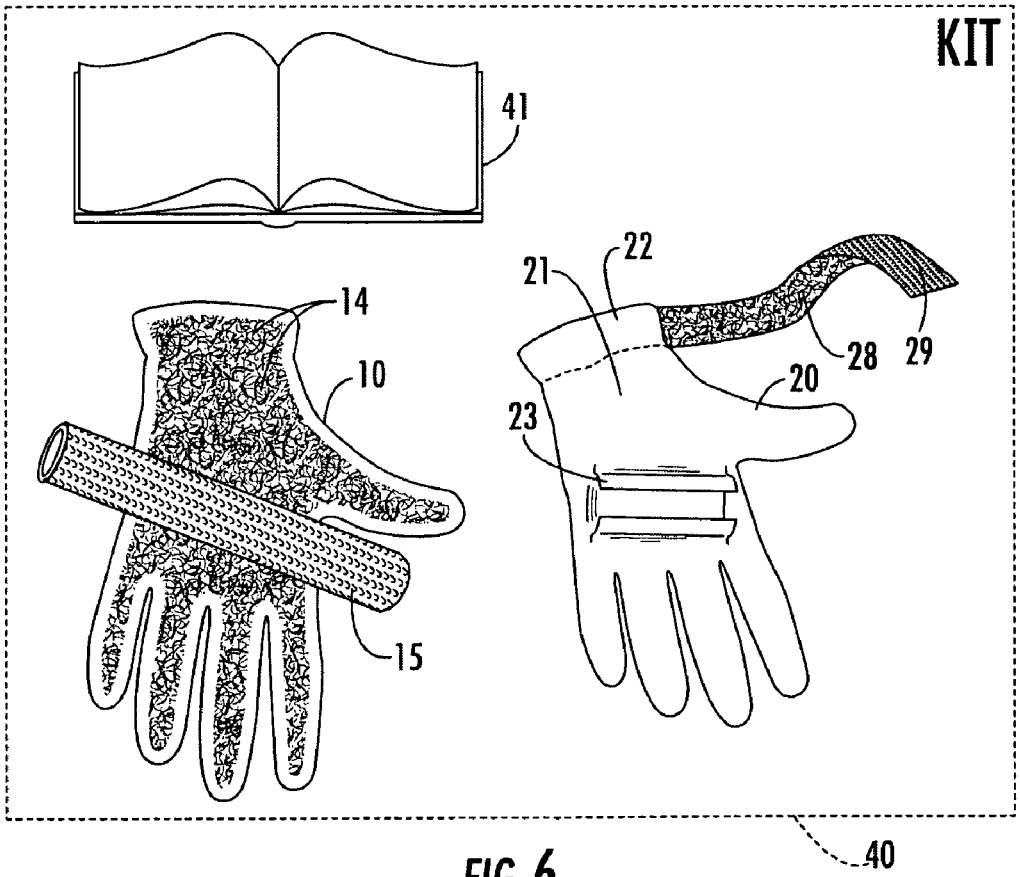
FIG. 6 is a diagram of a kit that includes golf gloves depicted in FIG. 1A and FIG. 3 and instructional material that instructs a person with insufficient control of one or more of their hands to improve strength and coordination.

FIG. 6 is a diagram of Kit 40 in accordance with an embodiment of the present invention. Kit 40 includes instructional material 41 that instructs the use of the golf glove 10 and golf glove 20 to develop strength and coordination, and to effectively enable a person having insufficient control of one or more hands to use a golf club for effectively striking a golf ball. For example, instructional material 41 can include an operating manual, video, DVD and the like.

Another embodiment of the present invention provides a system that can include golf glove 10, golf glove 20, second adhesion material 15, and instructional material 41 to enable a person to effectively develop strength and coordination, and to effectively enable the person having insufficient control of one or more hands to use a golf club for effectively striking or hitting a golf ball.

It is to be understood that the above-described embodiments are illustrative of only a few of the many possible specific embodiments which can represent applications of the principles of the invention. Numerous and varied other arrangements can be readily devised in accordance with these principles by those skilled in the art without departing from the spirit and scope of the invention.

What is claimed:

1. A method for assisting a person having insufficient control of one or more hands to use a golf club for effectively striking a golf ball, the method comprising the steps of:

positioning a first golf glove over a first of said hands having insufficient control, said first golf glove comprising a palm portion and a wrist portion; said palm portion having a holding bracket attached to said palm portion; and said wrist portion comprising a holding strap;

removably placing the golf club within said holding bracket and slidably positioning a handle portion of the golf club within said holding bracket;

wrapping said holding strap of said wrist portion of said first golf glove around said handle portion of the golf club and the first hand having insufficient control to enable the person having insufficient control of one or more hands to use said first golf glove to develop strength and coordination of the first hand for effectively striking the golf ball;

subsequently, positioning a second golf glove over a second of said hands, said second golf glove comprising a gripping area, said gripping area having a finger portion and a palm portion; said finger portion comprising a first adhesion material; and said palm portion comprising said first adhesion material;

placing a second adhesion material on said handle portion of the golf club; and grasping the golf club with said second golf glove wherein said first adhesion material of said gripping area of said golf glove is removably connected to said second adhesion material of said handle portion of the golf club to enable the person having insufficient control of one or more hands to use said first golf glove and said second golf glove for effectively striking the golf ball without the assistance of another person.

2. A system having instructional material for assisting a person having insufficient control of one or more hands to strengthen and improve coordination of the hand and use a golf club for effectively striking a golf ball, said system comprising:

a first golf glove comprising a palm portion and a wrist portion;

said palm portion having a holding bracket attached to said palm portion; and said wrist portion comprising a holding strap, said holding bracket and said holding strap securing a first of said hands having insufficient control to a handle portion of the golf club to enable the person having insufficient control of one or more hands to improve strength and coordination of the first hand for effectively striking the golf ball;

a second golf glove comprising a gripping area, said gripping area having a digit portion and a palm portion;

said digit portion comprising a first adhesion material;

said palm portion comprising said first adhesion material; and a second adhesion material adapted to be attached to said handle portion of the golf club, said first adhesion material of said gripping area of said second golf glove is removably connected to said second adhesion material of said handle portion of the golf club to enable the person having insufficient control of hand to use said second golf glove on a second of said hands for effectively striking the golf ball instructional material, wherein the instructional material instructs the person having insufficient control of one or more hands to use said first golf glove to strengthen and improve coordination of the first of said hands having insufficient control during use of golf club, and subsequently to use said second golf glove on the second of said hands to use the golf club for effectively striking the golf ball without the assistance of another person.

3. The system according to claim 2 wherein said holding bracket is formed of an elastomeric material.

4. The system according to claim 2 wherein said holding strap comprises an adhesion material, said adhesion material is a hook and loop fastening system.

5. The system according to claim 2 wherein said digit portion comprises at least three fingers.

6. The system according to claim 2 wherein said digit portion comprises four fingers and a thumb.

7. The system according to claim 2 wherein said gripping area comprises an entire inner surface of said second golf glove.

8. The system according to claim 2 wherein said golf glove is formed of said first adhesion material.

9. The system according to claim 2 wherein said first adhesion material and said second adhesion material are a loop and hook fastening system.

10. A kit for training a person having insufficient control of one or more hands for effectively striking a golf ball, said kit comprising:

a first golf glove comprising a palm portion and a wrist portion;

said palm portion having a holding bracket attached to said palm portion; and said wrist portion comprising a holding strap, said holding bracket and said holding strap securing a first of said hands having insufficient control to a handle portion of the golf club to enable the person having insufficient control of one or more hands to improve strength and coordination of the hand for effectively striking the golf ball;

a second golf glove comprising a gripping area, said gripping area having a digit portion and a palm portion;

said digit portion comprising a first adhesion material;

said palm portion comprising said first adhesion material; and a second adhesion material adapted to be attached to said handle portion of the golf club, said first adhesion material of said gripping area of said second golf glove is removably connected to said second adhesion material of said handle portion of the golf club to enable the person having insufficient control of hand to use said second golf glove on a second of said hands for effectively striking the golf ball; and instructional material, said instructional material instructs the person having insufficient control of one or more hands to use said first golf glove to strengthen and improve coordination of said first of said hands having insufficient control during use of golf club, and subsequently to use said second golf glove on said second of said hands for effectively striking the golf ball without the assistance of another person.

11. The kit according to claim 10 wherein said holding bracket is formed of an elastomeric material.

12. The kit according to claim 10 wherein said holding strap comprises an adhesion material, said adhesion material is a hook and loop fastening system.

13. The kit according to claim 10 wherein said digit portion comprises at least three fingers.

14. The kit according to claim 10 wherein said digit portion comprises four fingers and a thumb.

15. The kit according to claim 10 wherein said gripping area comprises an entire inner surface of said second golf glove.

16. The kit according to claim 10 wherein said second golf glove is formed of said first adhesion material.

17. The kit according to claim 10 wherein said first adhesion material and said second adhesion material are a loop and hook fastening system.

* * * * *